United States Patent [19]

Kessler

[11] 4,222,213

[45] Sep. 16, 1980

[54] INSULATING SPACER FOR DOUBLE INSULATED GLASS

[76] Inventor: Gerald Kessler, Box 389, McClurg Rd. at Southern Blvd., Youngstown, Ohio 44512

[21] Appl. No.: 960,648

[22] Filed: Nov. 14, 1978

[51] Int. Cl.[2] ..... E06B 7/12

[52] U.S. Cl. ..... 52/790; 52/172

[58] Field of Search ..... 52/172, 398, 399, 790

[56] References Cited

U.S. PATENT DOCUMENTS

| | | | |
|---|---|---|---|
| 2,746,102 | 5/1956 | Englehart et al. | 52/172 |
| 2,838,809 | 6/1958 | Zeolla et al. | 52/172 |
| 2,838,810 | 6/1958 | Englehart et al. | 52/172 |
| 4,057,945 | 11/1977 | Kessler | 52/398 |
| 4,069,630 | 1/1978 | Chess et al. | 52/398 X |
| 4,113,905 | 9/1978 | Kessler | 52/790 X |

*Primary Examiner*—James A. Leppink
*Assistant Examiner*—Carl D. Friedman
*Attorney, Agent, or Firm*—Browdy and Neimark

[57] ABSTRACT

An improved insulating spacer to reduce the heat transfer between the two panes of glass of double insulated glass comprises an extruded or roll-formed metal spacer together with a plastic insulating element which thermally isolates the metal spacer from the panes of glass while permitting conventional application of the sealant to provide reliable bonding. In one embodiment the plastic insulator comprises an extruded plastic overlay which fits tightly over part of a conventional metal spacer and has projecting contacts which abut the glass.

9 Claims, 3 Drawing Figures

INSULATING SPACER FOR DOUBLE INSULATED GLASS

FIELD OF THE INVENTION

The present invention relates to an improvement in the insulating spacers for double insulated glass disclosed in U.S. Pat. No. 4,057,945, issued Nov. 15, 1977, from application Ser. No. 733,902, filed Oct. 19, 1976. The entire contents of said KESSLER U.S. Pat. No. 4,057,945 are hereby incorporated herein by reference.

BACKGROUND OF THE INVENTION

A critical requirement in modern building construction is energy conservation. A particular problem in view of the extensive use of glass in modern architecture is a loss of heat from the building through glass surfaces. One solution has been the increased use of insulating glass units comprising basically two glass panels separated by a sealed dry air space. Sealed insulating glass units generally require some means of precisely separating the two glass panels. The spacers currently used are generally tubular channels of aluminum or some other metal containing a desiccant to keep the sealed air space dry.

A significant problem arises because the metal spacer is a much better heat conductor than the surrounding air space. This leads to the conduction of heat from the inside glass plate to the outside glass plate from where it is dissipated into the atmosphere. Further, there can result a differential dimensional change between the glass and the spacer causing stress to develop on the glass and on the seal which can result in damage to and the failure of the sealed glass unit.

There have been some attempts to use spacers made of polyvinyl chloride* rather than metal. This has, however, been unsuccessful because the sealants which have been developed to construct reliable units bond well to glass and metal spacers but not to polyvinyl chloride spacers; this leads to structural weaknesses in units constructed with PVC spacers. Furthermore, the differential dimensional change that occurs between glass and PVC spacers over a certain range of temperature is much higher than with a metal spacer. In addition, most plastics have been found unacceptable for use between glass panes because they give off volatile materials, e.g. plasticizers, which cloud or fog the interior glass surface.

* See "Factory-Sealed Double-Glazing Units," Solvason et al, *Canadian Building Digest,* October, 1963.

The prior art does show some examples of the use of plastic over another core material, but the details of construction and environment differ entirely from the present invention. U.S. Pat. No. 3,694,985, for example, shows a wooden mullion element covered with a plastic extrusion, but this is not a spacer for double insulated glass. U.S. Pat. No. 3,070,854 shows a plastic channel member provided to cover a wooden separator between a pair of glass panes and U.S. Pat. No. 2,239,517 shows a metal separator provided with a plastic coating used in window construction. Again, the details of these devices are totally different than the present invention.

My own U.S. Pat. No. 3,918,231 shows an extruded plastic element for fitting over a metallic frame element. U.S. Pat. No. 3,261,139 discloses a multiple glazed unit having a pair of resilient tape elements keyed to grooves in the separator. U.S. Pat. No. 3,012,642 relates to window structures using very complex pane holding elements. Canadian Pat. No. 953,159 shows a double glazed panel with tubular spacer held in place by a non-hardening cold flow adhesive. Offenlegungsschrift No. 1 434 283 also shows a spacer for double insulated glass.

However, none of these prior patents provides a solution to the problems raised above.

SUMMARY OF THE INVENTION

It is, accordingly, an object of the present invention to overcome the deficiencies of the prior art, such as indicated above.

It is another object of the present invention to provide for improved double insulated glass.

It is a further object to reduce heat transfer from one pane of glass to the other through the spacer element of double insulated glass.

The present invention utilizes an improved spacer element which combines the structural advantages of metal spacers with a plastic insulating element which reduces heat transfer. Because presently used sealants have proven strong and long-term adherent properties to glass and to metal but not to plastics, the present invention incorporates a metal spacer having portions for contacting the sealant to provide a solid bond between the glass plate and the metal spacer. The spacer may be the conventional extruded aluminum spacer having inwardly sloping portions along the sealing edge to form spaces which are filled with the sealant. However, the present invention incorporates a plastic insulator element, preferably extruded, to prevent any direct glass to metal spacer contact and further to provide only minimum contact with the glass plate so that a poor heat conduction path between the plates is formed while functioning as a spacer to keep the two glass plates a precise distance apart during construction of the sealed unit.

BRIEF DESCRIPTION OF THE DRAWINGS

The invention and its further objects and advantages will be better understood from the following detailed description of various embodiments, cited for the sake of illustration with reference to the accompanying drawings in which.

DETAILED DESCRIPTION OF EMBODIMENTS

The preferred embodiment of the present invention is an extruded plastic insulator which fits over a conventional metal spacer. The insulator element is of a one piece construction and is held mechanically affixed by contact pressure and/or friction along the upper center portion of the plastic insulator. Above a slot in the metal spacer is provided a series of holes through which the desiccant inside the metal spacer can communicate with the air space between the glass panes. Each edge of the insulator element which lies along the edge of the aluminum spacer for contact with the glass pane has at least one and preferably two narrow projecting contact edges extending generally perpendicular to the plane of the glass panes, which is the actual contact between the spacer and the glass. Two such projecting contacts provide better alignment stability, but since the four spacers forming the four sides of the sealed unit are joined together before construction, one contact on each edge is sufficient. Variations in widths of these contact projections determine the total width of the gap between the glass panes.

The plastic insulating elements are formed of an extrudable thermoplastic resin which gives off no volatile components and yet combines the advantages of heat resistance, dimensional stability, low moisture absorption and excellent processability. A polymer meeting these requirements is polyphenylene oxide, sold by G.E. under the name Noryl. PVC, on the other hand, and most other plastics as well, have not been found suitable because they cause fogging of the glass.

Figure 1:
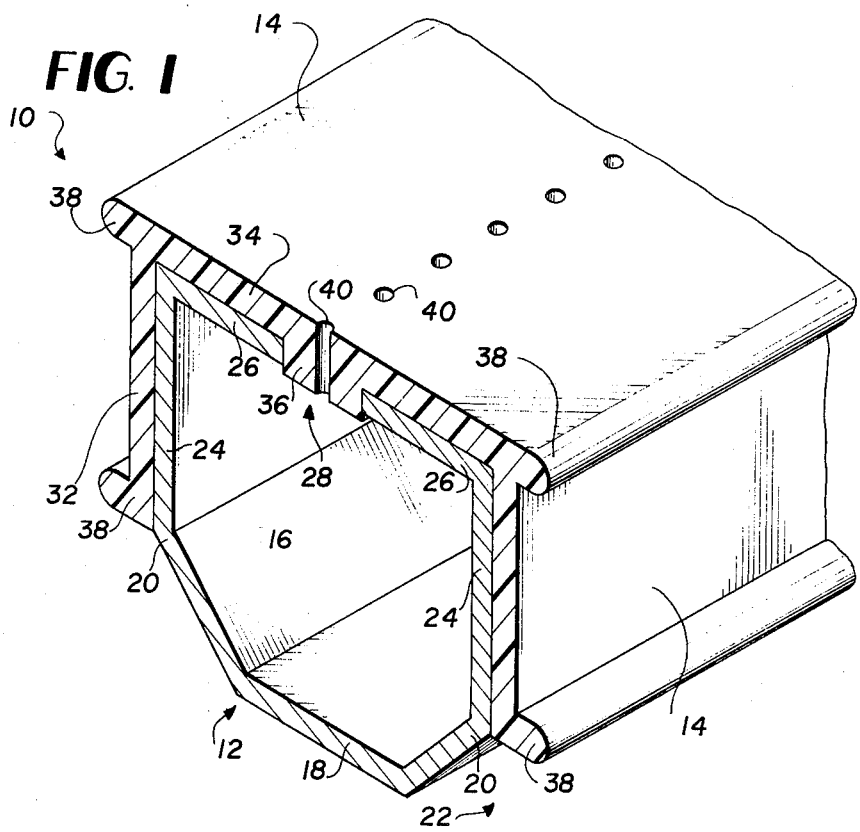
FIG. 1 shows an end perspective view of an embodiment of the invention in which a conventional metal spacer is provided with an extruded plastic insulator mounted to it.

The improved insulating spacer 10 as shown in FIG. 1 comprises a commonly used metal spacer 12 of extruded or roll-formed aluminum or steel and an extruded plastic insulator 14 which fits over the metal spacer 12. The metal spacer 12 forms a hollow channel 16 which is defined by an outer wall 18 which forms part of the edge of the sealed glass unit, sloped sealing walls 20 which form a space with the glass plate in which a sealant* is applied to bond the units together, lateral walls which are parallel or generally parallel to the panes of glass, and inside walls 26; a slot 28 runs the length of the spacer between the ends of walls 26 and allows a desiccant placed in the channel 16 of the spacer to be in gaseous contact with the air space between the sealed glass panes.

* Conventional sealants may be used in the present invention. A number of these are disclosed in "Sealants for Insulating-Glass Units", Strecker, *Adhesives Age,* November, 1975, hereby incorporated by reference.

The plastic insulator 14 constitutes a unitary element comprising a pair of lateral sides 32 which extend parallel to the glass plates, an upper or inner side 34 and an attachment flange or center leg 36 which frictionally holds the plastic insulator section to the metal spacer by fitting tightly within the slot 28. Thus, the attachment flange or center leg 36 extends into the slot 28 of the metal spacer 12 such as to contact the edges of the walls 26 thereof, while the sides 32 contact the walls 24 of the metal spacer, and the upper or inner wall 34 contacts the wall 26 of the spacer.

The width of the side 34 of the plastic insulating element 14 may be such that the fit with the metal spacer is tight so as to assist in retention, i.e. the walls 26 of th spacer 12 may be squeezed between the center flange 36 and the sides 32 of the insulator 14. However, this friction should not be so great that longitudinal shrinkage and expansion cannot occur with change in temperature due to different coefficients of expansion of the metal and plastic. If desired, some type of adhesive, e.g. EVA adhesive, could also be used to ensure permanent contact between the elements, although this expedient is not preferred since it introduces the possibility of glass fogging, even when only small quantities of adhesive are used.

Figure 2:
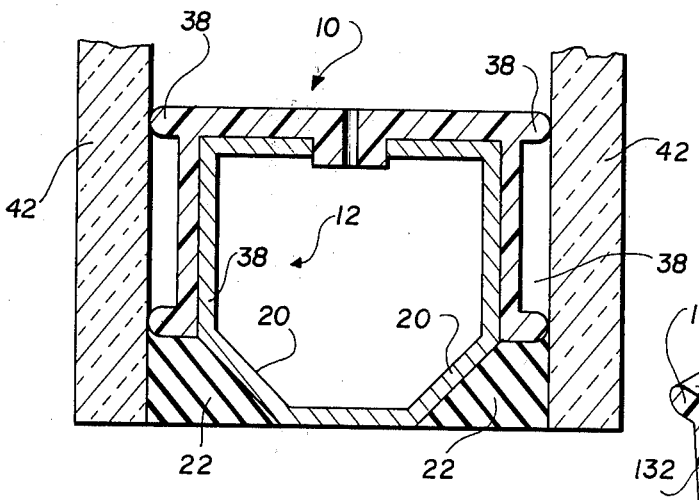
FIG. 2 shows a cross-sectional view of the details of construction of a sealed glass unit with the insulator shown in FIG. 1.

The lateral sides 32 of the plastic insulator each have at least one thin, extended contact flange 38 which projects outwardly from the side 32 for contact with the glass plate 42 (see FIG. 2). The width of these contact flanges 38 is variable and can be selected to provide the desired width between the glass plates. If only one contact projection 38 is provided on each side 32, then the width of side 32 need not be the full width of the wall 24 of the metal spacer but it can be considerably shortened to save plastic material, since the single contact can be near the side 34. If two contact flanges 38 are provided on each side 32, then they can be positioned at the edges as shown in FIG. 1 or at other points along the side 34 since the position is not critical. It is these thin contact edges 38 which greatly reduce heat transfer between the plates since the plastic is a poor heat conductor and, furthermore, only minimum contact is maintained between the glass plates through the spacer because of the small contact area of the flanges 38. Furthermore, since the contact is minimized, differential dimensional changes due to different expansion coefficients will be of minimum effect and little if any additional stress will be placed on the glass unit.

Provided through the thickness of the central flange 36 are a series of spaced holes 40, of relatively small diameter, e.g. on the order of about 0.002 inches. These holes, which may suitably, practically and economically be formed by the use of laser technology, serve to permit gas to pass between the hollow channel 16 and the space between the window panes. Desiccant maintained within the hollow channel 16 of the metal spacer 12 is thus able to absorb any moisture trapped between the window panes by passage of the water vapor through the small diameter holes 40.

The construction of a sealed glass unit is shown in FIG. 2 where the glass plates 42 are separated by the insulating spacer 10. The spaces between the walls 20 and the glass panes 42 have been filled with sealant 22 to bond the unit together and the insulating flanges 38 keep the glass plates 42 in thermal isolation from the metal spacer 12 greatly reducing heat flow between the plates through the spacer.

Figure 3:
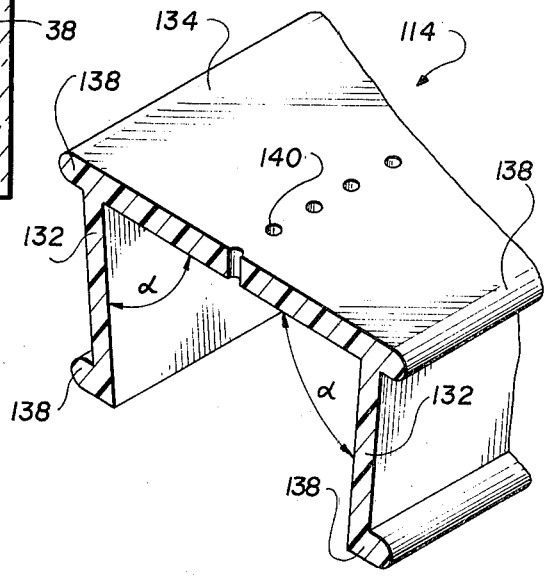
FIG. 3 shows an end perspective view of a second embodiment of the invention.

Another similar embodiment is shown in FIG. 3 which shows a plastic insulator 114 having a pair of lateral sides 132, an upper or inner side 134 and four extending contact flanges 138. The plastic insulator 114 also is provided with a series of small diameter holes 140, preferably formed by the use of lasers. The various elements function in the same manner as described above with relation to the embodiment of FIGS. 1 and 2. In the embodiment of FIG. 3, on the other hand, no central attaching flange is provided to frictionally maintain the plastic insulator in place on the metal spacer. Instead, the sides 132 are formed at an acute angle $\alpha$ from the plane of the inner wall 134 such that when the insulator 114 is placed over the spacer 12, the walls 132 squeeze the walls 24 of the spacer 12 to retain the insulator in proper place. A suitable angle $\alpha$ is 85°. It will be understood, of course, that in this embodiment the width of the side 134 facing the spacer should be substantially equal to the width of the spacer, so that the wall 26 of the spacer 12 will be squeezed widthwise between the walls 132 of the insulator 114. It will also be readily understood that when the insulator 114 has been placed over the spacer, the walls 132, and particularly the lower portions thereof, will be moved outwardly so that the angle $\alpha$ will be stretched to esentially 90°.

It will be understood that the insulating spacer of the present invention will be easily formed by continuous extrusion through a die of suitable shape. Formation of the holes 40 and 140 may be provided by a timed laser located downstream of the extrusion orifice, or by other conventional methods such as the provision of an optical sensing element capable of sensing identification marks formed in the extrudate at measured locations from a reference location.

The advantages of the combined spacer are the reduced heat transfer characteristics from the use of the plastic insulator and the structural rigidity from the continued use of the metal spacer. Since the overall width of the sealed glass unit can be adjusted by varying the width of the plastic insulator only one standard size of the aluminum spacer need be used in combination with various plastic insulators which are easily made in various sizes.

Of course, other embodiments and adaptations may be provided without going beyond the scope of the invention. It will be obvious to those skilled in the art that various changes may be made without departing from the scope of the invention and the invention is not to be considered limited to what is described in the specification.

What is claimed is:

1. An insulating spacer for precision separation of plates in double insulated glass, comprising:

a metal spacer for interposition between two glass panes, said metal spacer permitting conventional sealant bonding of the glass to the spacer, said metal spacer having a slot running the length thereof; and insulating means attached to said metal spacer to thermally isolate said metal spacer from the two panes of glass, thereby greatly reducing the heat transfer from one pane of glass to the other through the spacer, said insulating means comprising an elongated plastic element formed of unitary, generally U-shaped section fitting tightly to a portion of said metal spacer and fixedly attached thereto by friction, said insulating means covering at least a portion of the two sides of the spacer which contact the glass plates, said insulator having a series of small diameter holes extending therethrough and aligned with the slot running the length of said metal spacer, the legs of said U-shaped element being biased toward one another, said frictional engagement being provided by the body of said metal spacer forcing said legs apart.

2. An insulating spacer as claimed in claim 1, wherein said plastic insulator is made of extruded polyphenylene oxide.

3. An insulating spacer as claimed in claim 1, having at least one projecting contact edge extending the length thereof on each side thereof, said contact edges being located along the surfaces of the insulator which contact the glass plates.

4. An insulating spacer as claimed in claim 1 having two projecting contact edges on each side thereof running the length thereof.

5. An insulating spacer as claimed in claim 1, further comprising an elongated center flange projecting into the slot in said metal spacer for providing said frictional engagement.

6. In double insulated glass comprising a pair of separated glass panes, an air space therebetween, a metallic separator between said glass panes about their periphery, and a plastomeric or elastomeric sealant bonding said metallic separator to said glass panes and sealing the air space therebetween, the improvement comprising:

means to reduce heat transfer from one glass pane to the other through said metallic separator, said heat transfer reducing means comprising a generally U-shaped, elongated, self-supporting thermoplastic unitary insulating strip interposed between said metallic separator and said glass panes to thermally isolate said metallic separator from said glass panes, said insulating strip being formed of a thermoplastic material which does not give off any volatile material, said insulating strip frictionally engaging said metallic separator so that it is fixedly held thereto and covers at least a portion of the two sides of the separator so as to lie between said glass panes and said separator walls, said metallic separator being hollow and having an opening between the air space and the hollow of said spacer, a desiccant within the hollow of said spacer, and wherein said elongated insulating strip is provided with a series of holes of smaller diameter aligned with the opening of said metallic separator.

7. An insulating spacer as claimed in claim 6 having two projecting contact edges on each side of said U-shaped strip running the length therof.

8. An insulating spacer as claimed in claim 6 further comprising an elongated center flange projecting from said insulating strip into the slot in said metal spacer for providing said frictional engagement.

9. An insulating spacer as claimed in claim 6, wherein the legs of said U-shaped insulating strip are biased toward one another, said frictional engagement being provided by the body of said metal spacer forcing said legs apart.

* * * * *